US005746333A

United States Patent [19]

Wuertemberger

[11] Patent Number: 5,746,333

[45] Date of Patent: May 5, 1998

[54] RIGID STORAGE DEVICE WITH VARIABLE SIZED CELLS

[75] Inventor: Kim Wuertemberger, Richmond, Ind.

[73] Assignee: Contract Industrial Tooling, Inc., Richmond, Ind.

[21] Appl. No.: 611,276

[22] Filed: Mar. 5, 1996

[51] Int. Cl.[6] ..... A47F 5/00

[52] U.S. Cl. ..... 211/189; 211/182

[58] Field of Search ..... 211/189, 194, 211/182, 183; 312/111; 52/282.1, 282.2, 282.4, 282.5; 108/60, 42, 44; 296/39.2; 220/4.31, 529, 532, 533, 544, 553; 446/105, 111

[56] References Cited

U.S. PATENT DOCUMENTS

| | | | |
|---|---|---|---|
| 3,528,559 | 9/1970 | Miller | 211/182 X |
| 3,841,726 | 10/1974 | Andros et al. | 211/189 X |
| 4,493,425 | 1/1985 | Yoshida | 211/182 X |
| 4,557,091 | 12/1985 | Auer | 52/282 |
| 4,969,568 | 11/1990 | Yoshida | 211/189 X |
| 5,172,817 | 12/1992 | Gross | 211/182 X |

FOREIGN PATENT DOCUMENTS

| | | | |
|---|---|---|---|
| 2241061 | 2/1974 | Germany | 52/282.2 |
| 1081423 | 8/1967 | United Kingdom | 52/282.2 |
| 2064617 | 6/1981 | United Kingdom | 52/285.1 |

*Primary Examiner*—Leslie A. Braun
*Assistant Examiner*—Sarah L. Purol
*Attorney, Agent, or Firm*—Woodard, Emhardt, Naughton Moriarty & McNett

[57] ABSTRACT

A storage device having a plurality of parallel sizable compartments. The preferred embodiment includes a plurality of horizontally extending and vertically extending sheet members having edge portions extending into flanges of cross-shaped holders. T-shaped holders removably receive and hold the opposing edge portions of sheet members located around the periphery of the storage device and further include inwardly projecting flanges to receive the internally located horizontally extending and vertically extending sheet members. L-shaped corner holders have opposing flanges receiving the adjacent edge portions of vertically extending and horizontally extending external sheet members. Caps removably mount to the ends of the holders. In an alternate embodiment, the horizontal sheet members and vertical sheet members are connected together by mating slots.

4 Claims, 8 Drawing Sheets

RIGID STORAGE DEVICE WITH VARIABLE SIZED CELLS

BACKGROUND OF THE INVENTION

1. Field of the Invention

This invention is in the field of trays and other storage devices for holding objects.

2. Description of the Prior Art

A variety of organizations including manufacturing facilities utilize various types of storage devices for holding and moving objects from site to site. It is the custom to utilize trays for holding the objects with the trays being stackable or connected together providing a tray assembly. The objects to be stored have a variety of shapes and sizes and thus it is desirable to provide a storage device constructed from readily assembled standardized components which may be pre-selected by the user depending upon the size and configuration of the cells or compartments within the storage device. In order to minimize the cost of the storage device, it is desirable to minimize the number of components required for construction of the storage device.

The aforementioned storage devices typically are transported to different locations with the various objects therein. To facilitate the transportation, it is desirable to provide a low weight storage device. Further, the storage device must be sufficiently strong and rigid to support heavy objects.

Disclosed herein is a storage device having a relatively few number of components which may be assembled with relative ease and even allowing reassembly to create different sized compartments. The device is constructed of relatively thin but rigid walls allowing the entire storage device to be readily transported.

The packaging system disclosed herein is particularly useful to package relatively long parts in the horizontal position with the cells being sized to any desired size through the use of rigid walls. The multiple celled storage system replaces individual tote boxes eliminating the necessity of handling individual packages. The system is designed to insert and remove the objects held from the side of the storage device rather than through the top or vertical end. The cells may not only be sized to fit the particular object but the number of cells may be increased or decreased providing a custom built storage device.

Storage devices typically are exposed to rough handling resulting in damage to the storage device. Our storage device may be easily repaired allowing components to be replaced without disassembly of the whole unit. The storage device may be therefore reworked and recycled. At the conclusion of either the use or life of the storage device, it can be easily disassembled and either reworked using some of the same components creating a new unit size or the components can be separated and recycled into other storage devices.

SUMMARY OF THE INVENTION

One embodiment of the present invention is a storage device having a plurality of parallel extending compartments comprising a plurality of sheet shaped horizontally extending members having first edge portions with the horizontally extending members arranged in vertical rows and horizontal rows. A plurality of sheet shaped vertically extending members have second edge portions with the vertically extending members spacing the horizontal rows apart and cooperatively with the horizontally extending members defining a plurality of compartments. A plurality of cross shaped holders each have a pair of spaced apart first flanges and a pair of spaced apart second flanges. The first flanges open in an opposite direction than the second flanges and receive adjacent but spaced apart first edge portions of the horizontally extending members. The holders further have a pair of spaced apart third flanges and a pair of spaced apart fourth flanges with the third flanges opening in an opposite direction than the fourth flanges and receiving adjacent but spaced apart second edge portions of the vertically extending members. A plurality of T-shaped side holders each have a pair of spaced apart fifth flanges opening inwardly toward the compartments receiving the first edge portions of the horizontally extending members. The T-shaped holders further have a pair of spaced apart sixth flanges and a pair of spaced apart seventh flanges opening in opposite directions and receiving the second edge portions of the vertically extending members. A plurality of T-shaped end holders each have a pair of spaced apart eighth flanges opening inwardly toward the compartments receiving the second edge portions of the vertically extending members. The T-shaped end holders further have a pair of spaced apart ninth flanges and a pair of spaced apart tenth flanges opening in opposite directions and receiving the first edge portions of the horizontally extending members. A plurality of L-shaped holders each have a pair of spaced apart eleventh flanges and a pair of spaced apart twelfth flanges arranged perpendicularly receiving respectively the first edge portions and the second edge portions forming corners of the storage device.

It is an object of the present invention to provide a new and improved storage device having a plurality of horizontally extending storage compartments.

A further object of the present invention is to provide a storage device having a plurality of storage cells which may be changed in both number and size.

In addition, it is an object of the present invention to provide a storage device with multiple storage compartments which may be easily repaired.

Related objects and advantages of the present invention will be apparent from the following description.

DESCRIPTION OF THE PREFERRED EMBODIMENTS

Figure 1:
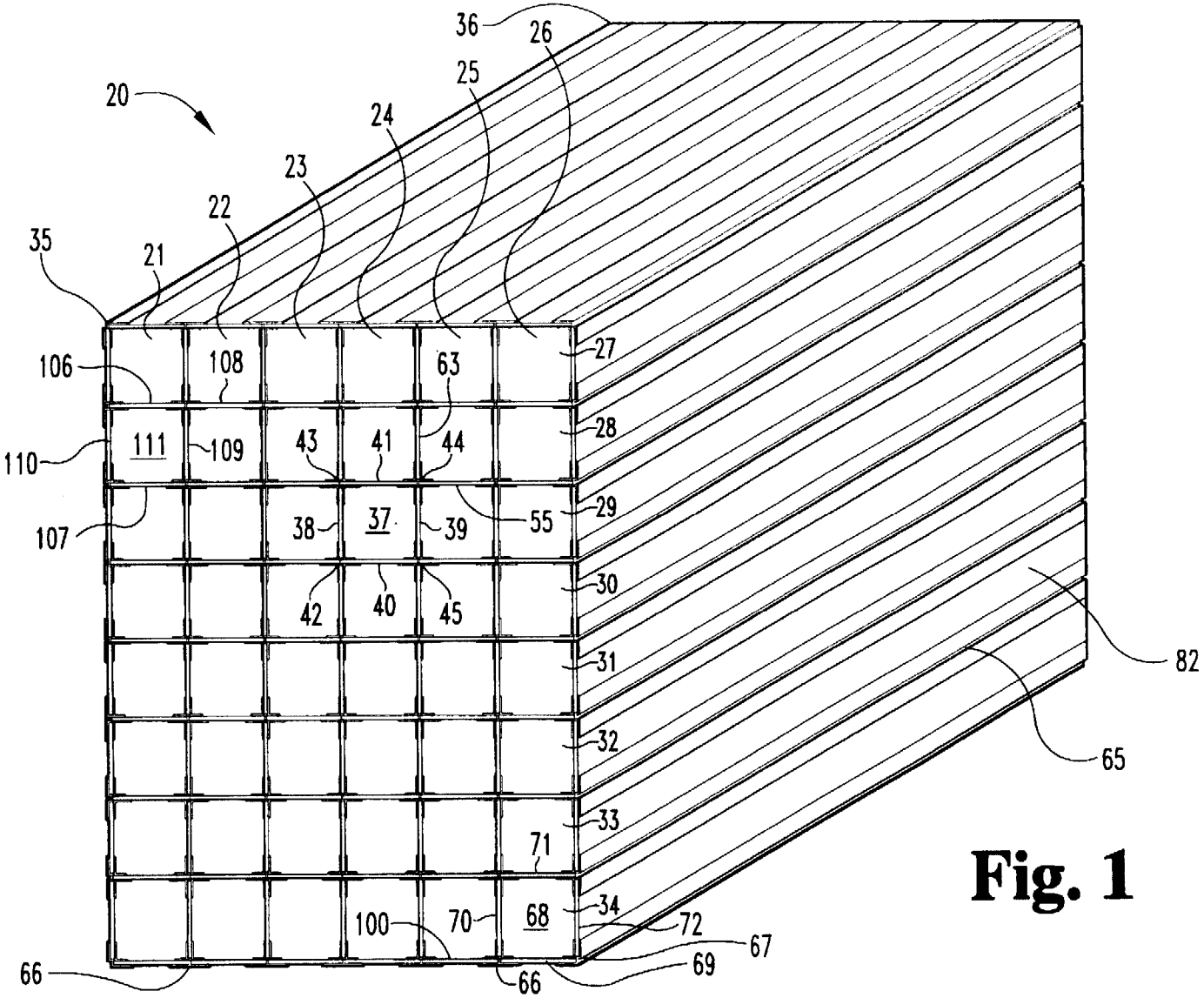
FIG. 1 is a perspective view of the preferred embodiment of the storage device.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a perspective view of a storage device 20 having a plurality of parallel extending compartments formed from a plurality of horizontally extending members and vertically extending members removably secured together by holders. In the preferred embodiment of FIG. 1, storage device 20 has compartments arranged in six vertical rows 21–26 and eight horizontal rows 27–34. It is to be understood that the present invention contemplates and includes a storage device having storage compartments arranged in horizontal and vertical rows greater or less than the number of rows depicted in FIG. 1.

Each compartment extends from end 35 to end 36 of the storage device. Each compartment is formed from a pair of parallel vertically extending sheet members and a pair of parallel horizontally extending sheet members extending from end 35 to end 36. Compartment 37 will now be described it being understood that a similar description applies to the remaining compartments. Compartment 37 is formed by the two vertically extending sheet shaped members 38 and 39 mounted to and between horizontally extending sheet shaped members 40 and 41. Members 38–41 extend continuously from end 35 to end 36 and are held together by four identical cross-shaped holders 42–45.

Figure 8:
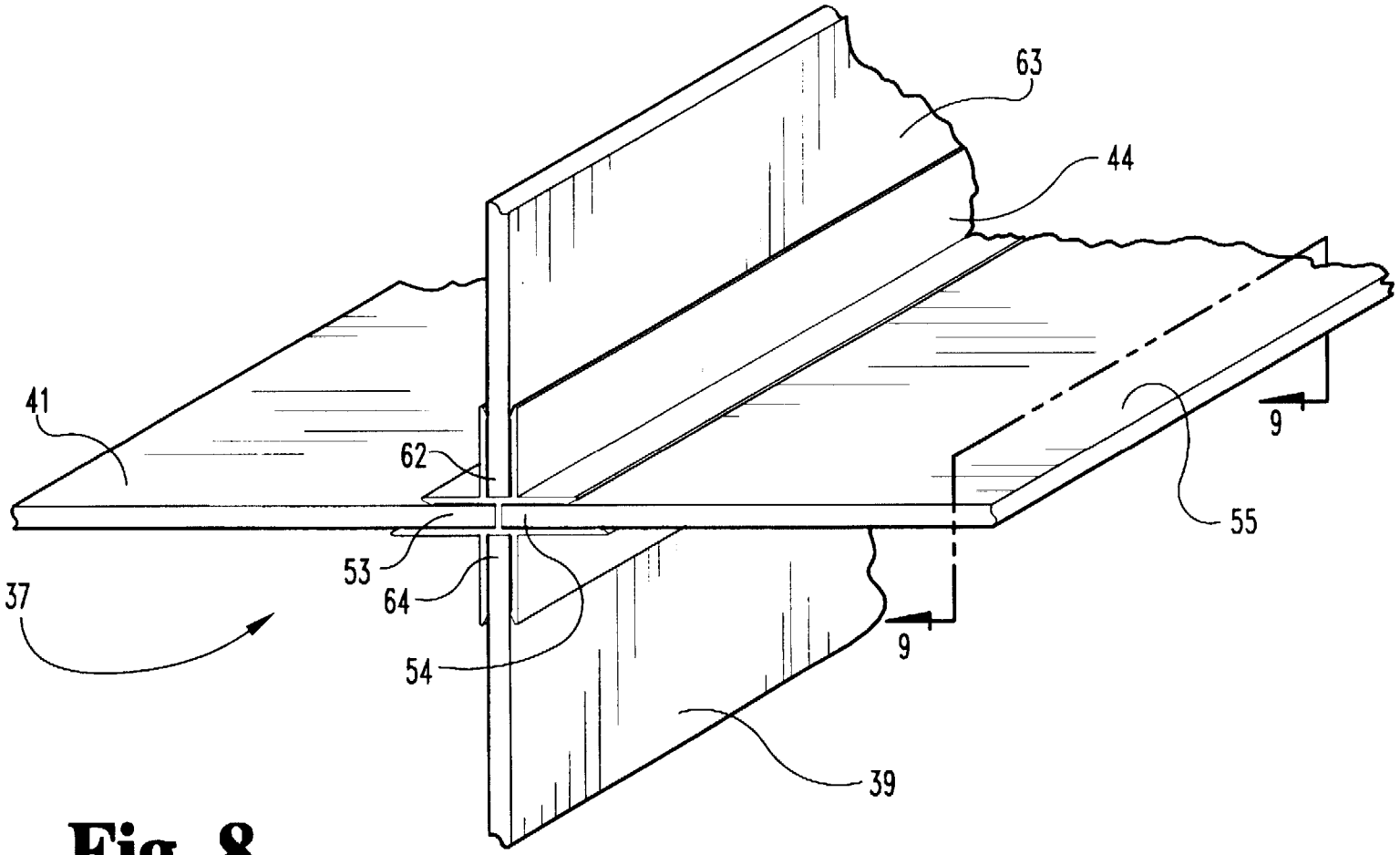
FIG. 8 is an enlarged fragmentary perspective view of the holder and rigid walls enclosed within circle 8 of FIG. 1.

Cross-shaped holder 44 will now be described it being understood that a similar description applies to the cross-shaped holders 41, 42 and 45. Holder 44 (FIG. 2) includes a pair of spaced apart parallel first flanges 46 and 47 and a pair of spaced apart parallel second flanges 48 and 49. An intermediate wall 50 is integrally and perpendicularly joined between and to flanges 46, 48 and 47, 49. Thus, a pair of oppositely opening recesses 51 and 52 are formed respectively between flanges 46, 47 and 48, 49. Flanges 46 and 47 are sized to frictionally receive therebetween the edge portion 53 of member 41 (FIG. 8) whereas the edge portion 54 of horizontally extending sheet member 55 extends frictionally between flanges 48 and 49 into recess 52. Holder 44 further includes a pair of spaced apart and parallel third flanges 56 and 57 forming an upwardly opening recess 58 and a pair of spaced apart and parallel fourth flanges 59 and 60 forming recess 61. Recesses 58 and 61 open in opposite directions and are sized to allow the associated flanges to frictionally engage respectively the edge portions 62 of vertical sheet member 63 and the edge portion 64 of vertical sheet member 39. In a similar manner, all of the compartments are formed except those compartments which are located at the extreme surrounding edge of the storage device. The cross-shaped holders extend continuously with the horizontal and vertically extending sheet members from end 35 to end 36 of the device. As an example, flanges 46–49 and 56, 57, 59 and 60 extend uninterrupted from end 35 to end 36.

Figure 3:
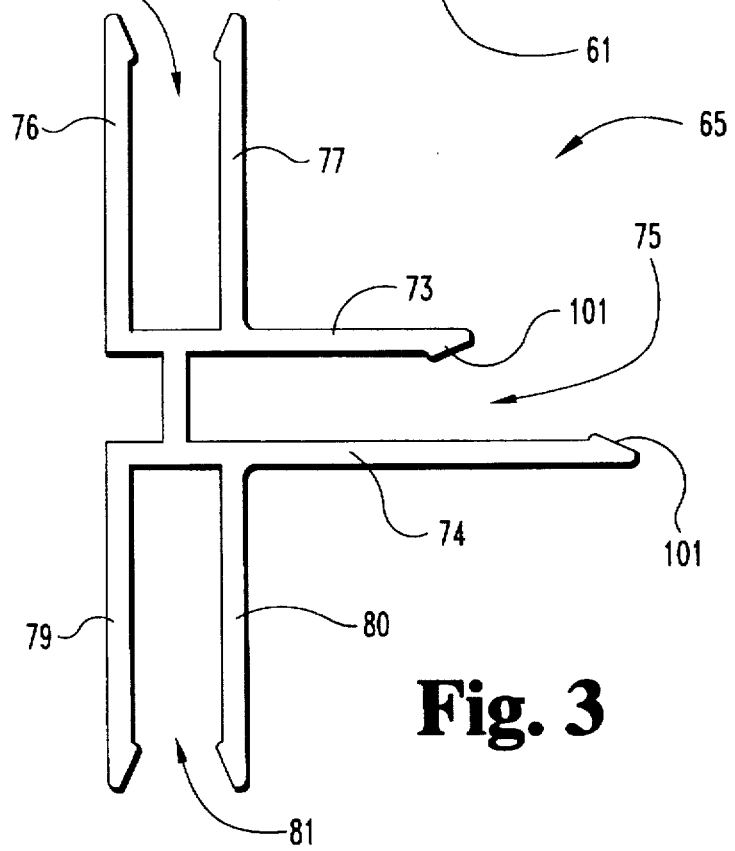
FIG. 3 is an end view of the T-shaped side holders.
Figure 4:
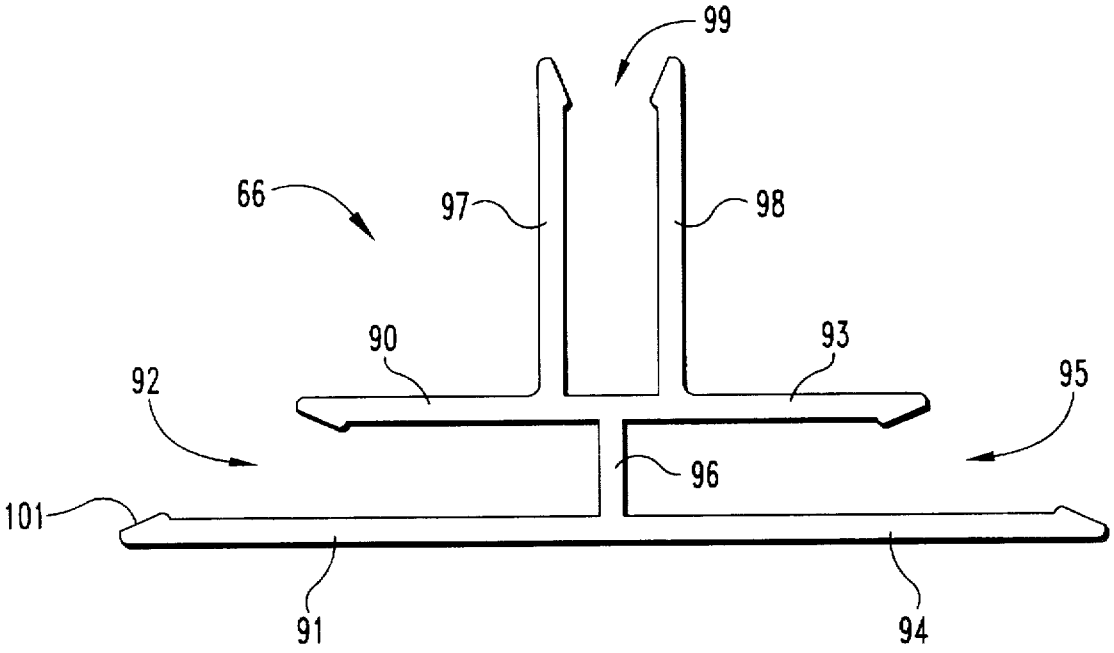
FIG. 4 is an end view of the T-shaped end holders.

In addition to holder 44, three other types of holders are used to secure the vertical and horizontally extending members along the extreme edge of the storage device. The T-shaped holders 65 (FIG. 3) are positioned along the vertical sides of device 20 whereas the T-shaped holders 66 (FIG. 4) are positioned along the top and bottom horizontally extending edges of the storage device. A corner holder 67 (FIG. 5) is positioned at the four corners of the storage device.

Compartment 68 (FIG. 1) will now be described at being understood that a similar description applies to the compartments formed at the three other corners of the storage device 20. Compartment 68 is formed from the pair of horizontally extending and parallel sheet members 69 and 71 arranged perpendicularly and extending between the pair of vertically extending spaced apart and parallel sheet members 70 and 72. Members 70 and 71 are secured together by a cross-shaped holder identical to that previously described and shown in FIG. 2. Members 71 and 72 are secured together by T-shaped holder 65 shown in FIGS. 1 and 3. Holder 65 includes a pair of spaced apart and parallel fifth flanges 73 and 74 forming recess 75, a pair of spaced apart parallel sixth flanges 76 and 77 forming recess 78 and a pair of spaced apart and parallel seventh flanges 79 and 80 forming recess 81. Flanges 73 and 74 extend across the ends of recesses 78 and 81 and are spaced apart by an integral and perpendicularly arranged wall 82. Wall 82 is positioned along a line extending between flanges 76 and 77 and between flanges 79 and 80 thereby locating the edge portion of member 71 between the top edge portion of member 72 and the bottom edge portion of member 82 (FIG. 1). In other words, the horizontally extending sheet member extends at least partially between and spaces apart the pair of aligned vertical sheet members 72 and 82. In a similar manner, a T-shaped holder 65 is located, except at the four corners, at the intersection of each horizontally extending member and pair of vertically extending members along the two extreme outer vertical sides of storage 20. Flanges 73, 74, 76, 77, 79 and 80 extend continuously from end 35 to end 36.

Corner holder 67 (FIG. 5) has an L-shape and includes a pair of spaced apart and parallel flanges 83 and 84 forming recess 85 which are perpendicularly arranged to a pair of spaced apart and parallel flanges 86 and 87 forming recess 88. Wall 89 forms the end of recess 85 and is located along a line equidistant between flanges 86 and 87. The bottom edge portion of vertical sheet member 72 is frictionally engaged by walls 86 and 87 and fits within recess 88 whereas horizontally extending sheet member 69 has an outer edge portion extending into and recess 85 being held by flanges 83 and 84. In a similar manner, a corner holder identical to L-shaped holder 67 is located at the other three corners of the storage device with recess 88 receiving the edge portion of the vertically extending associated member and with recess 85 receiving the edge portion of the horizontally extending member. Flanges 83, 84, 86 and 87 extend the length of the storage device between ends 35 and 36.

Sheet members 69 and 70 are secured together by T-shaped end holder 66 (FIG. 4) which includes a pair of spaced apart and parallel flanges 90 and 91 forming recess 92 and spaced apart and parallel flanges 93 and 94 forming recess 95. The ends of recesses 92 and 95 are formed by an intermediate wall 96 perpendicularly arranged relative to flanges 91 and 94 and located along a line equidistant between flanges 97 and 98 forming recess 99, in turn, perpendicularly arranged to flanges 90 and 93. The edge portion of horizontally extending member 69 is held within recess 95 whereas the edge portion of horizontally extending member 100 is held within recess 92. Likewise, the bottom extending edge portion of vertical sheet member 70 is held within recess 99. Notably, the vertically extending sheet member 70 does not extend between horizontally extending members 69 and 100 whereas the outer edge portion of horizontally extending sheet member 71 extends between sheet members 72 and 82. The horizontally extending members and vertically extending members are supported along their entire length by the cross-shaped holders of FIG. 2, except in the instance of the outer vertically extending members and horizontally extending members located along the periphery of storage device 20, the members are supported along their entire length by the T-shaped holders of FIGS. 3 and 4 and in the instance at the corners by the L-shaped holders of FIG. 5.

The flanges of the holders of FIGS. 2–5 have inwardly projecting barbs which frictionally but releasably engage and hold the edge portion of the horizontally extending members and vertically extending members but allow for removal and reinsertion of different sized horizontal extending members and vertically extending members for sizing of the compartments or repair of the storage device. For example, flanges 59 and 60 of holder 44 (FIG. 2), flanges 73 and 74 of holder 65 (FIG. 3), flanges 90 and 91 of holder 66 (FIG. 4), and flanges 83 and 84 of holder 67 (FIG. 5) have inwardly shaped barbs 101 to frictionally engage the sheet members. Best results have been achieved by producing the holders of FIGS. 2–5 from extruded aluminum whereas the vertically extending and horizontally extending sheet members are produced from plastic.

Figure 5:
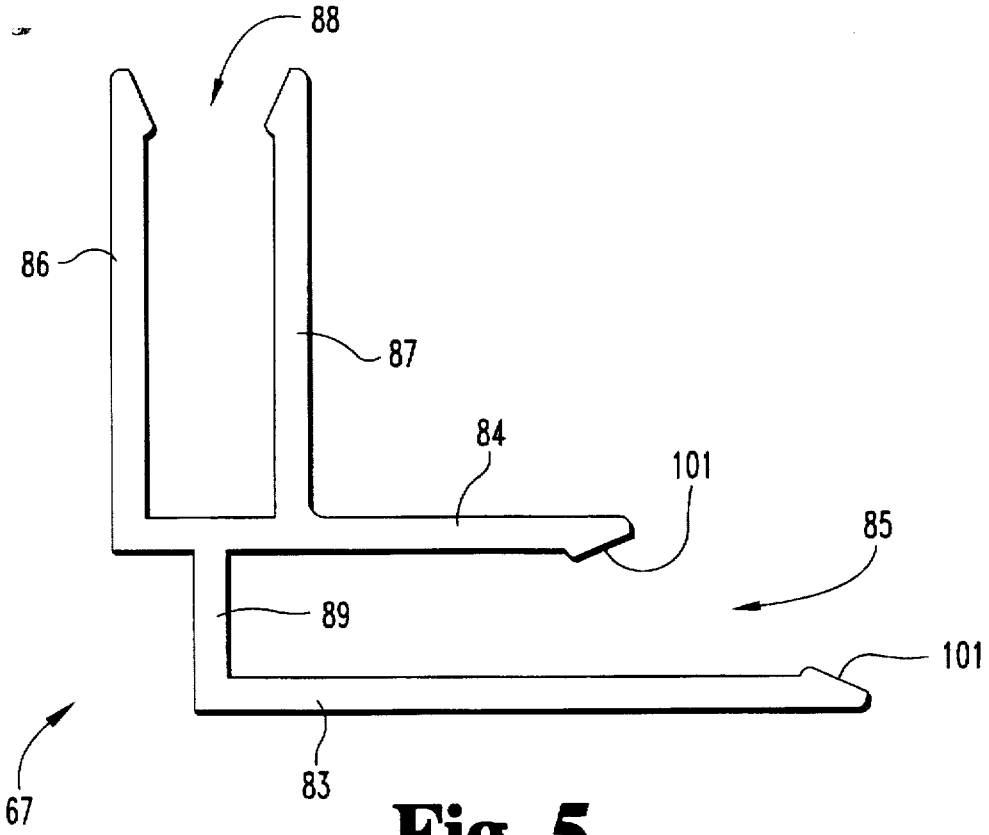
FIG. 5 is an end view of the L-shaped corner holders.

The upper flange of each pair of horizontally extending flanges of the holders of FIGS. 2–5 extend a shorter distance as compared to the lower flange of the same pair. For example, flanges 46 and 48 are shorter than flanges 47 and 49 of holder 44 (FIG. 2), flange 73 is shorter than flange 74 of holder 65 (FIG. 3), flanges 90 and 93 are shorter than flanges 91 and 94 of holder 66 (FIG. 4) and flange 84 is shorter than flange 83 of holder 67 (FIG. 5). The upper flange is a non-load bearing flange and thus is not required to have the length of the lower load bearing flange of the same pair thereby decreasing the cost of each holder.

The horizontally extending members and vertically extending member each include a pair of sheets which are separated by corrugated shaped elements. For example, horizontally extending sheet 55 (FIG. 8) includes a pair of parallel but spaced apart plastic sheets 102 and 103 (FIG. 9) joined together but spaced apart by a plastic corrugated shaped intermediate sheet 104. Sheet 104 extends through a series of rolls and ridges along its length which is also in the direction from end 35 to end 36 (FIG. 1) of the storage device. Optionally, in order to increase the rigidity of the storage device, a plurality of wires 105 may be extended between sheets 102 and 103.

One particular advantage of the storage device is that all of the vertical extending sheet members are of the same size. Likewise, all of the horizontally extending members are of the same size, thereby allowing interchange and repair of the various components. The horizontally extending members are arranged in vertical rows and horizontal rows. For example, horizontally extending sheet members 106 and 107 (FIG. 1) are arranged in a vertical row whereas sheet members 106 and 108 are arranged in a horizontal row. The vertically extending members space the horizontal rows apart and cooperatively with the horizontally extending members define the plurality of compartments. For example, vertically extending member 109 spaces member 106 from member 107 and cooperatively with the two horizontally extending members along with vertically extending member 110 define the enclosed compartment 111.

Figure 6:
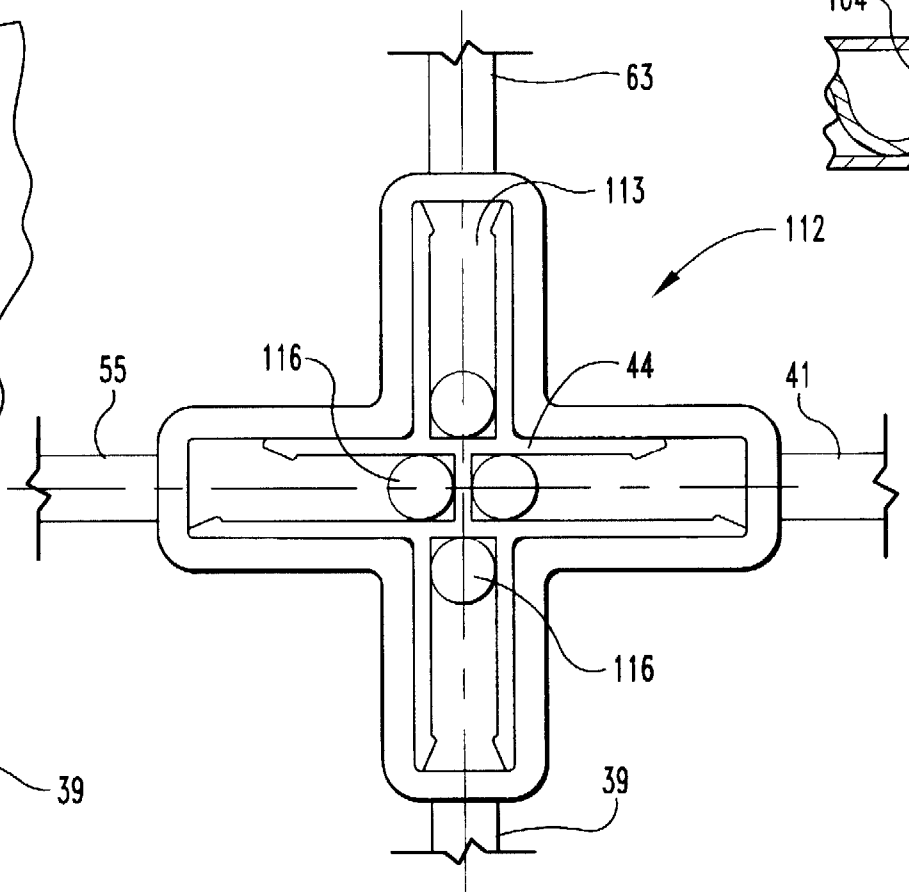
FIG. 6 is an end view of a cap mounted to an end of the holder of FIG. 2.
Figure 10:
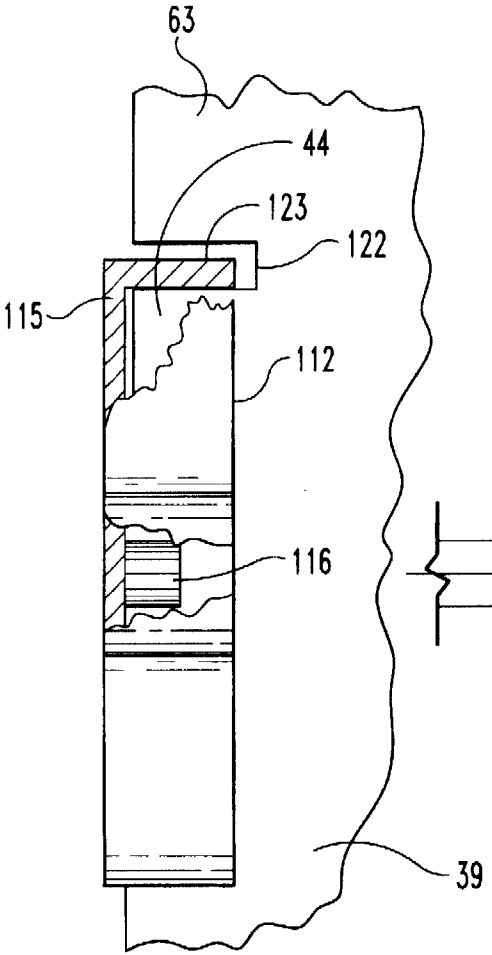
FIG. 10 is a fragmentary side view of the cap of FIG. 6.

A plurality of caps are removably mounted to the ends of the holders of FIGS. 2–5 and have been removed from FIG. 1 to more clearly illustrate the inter-connections of the vertically extending and horizontally extending members. Cap 112 (FIG. 6) as a cross-shaped internal cavity 113 to receive the end of the cross-shaped holder 44 illustrated in FIG. 6. Holder 112 includes a bottom wall 115 with a plurality of side walls 123 integrally joined thereto forming the cross-shaped cavity 113. A plurality of plugs 116 project outwardly from wall 115 (FIG. 10) at the center of the holder. Plugs 116 extend between the pairs of flanges of the holder and into the vertically extending and horizontally extending sheet members removably securing the cap to the end of the holder.

Figure 7:
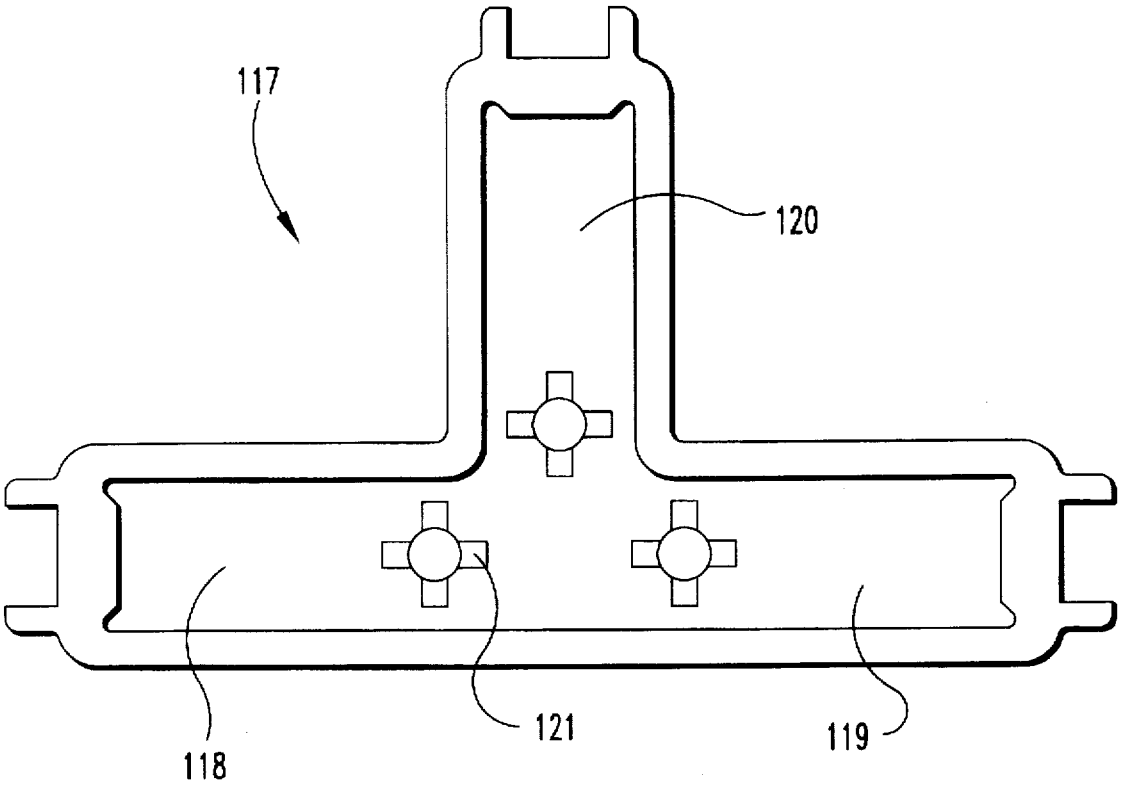
FIG. 7 is an end view of the side/end caps.

Holders 65, 66 and 67 (FIGS. 3–5) also include caps similar to caps 112 which are mounted to the ends of the holder with the caps having plugs extending interferingly between the adjacent holder flanges and into the vertically extending and horizontally extending sheet members to removably hold the caps thereto. For example, T-shaped holder 117 (FIG. 7) includes three cavities 118, 119 and 120 formed by a base wall from which project a plurality of side walls with holder 117 being removably mounted to the ends of holders 65 and 66. For example, flanges 79 and 80 of holder 65 fit within recess 119 whereas flanges 76 and 77 fit within recess 118 with the third pair of flanges 73 and 74 fitting within recess 120. The plurality of plugs 121 extend outwardly from the base wall of the holder and between the pair of flanges in a manner similar to that described for cap 112.

Slots are formed in the horizontally extending and vertically extending members to accommodate the side walls of the holders. For example, sheet member 63 extends into recess 113 (FIG. 6) and includes a slot 122 into which side wall 123 (FIG. 10) of the holder projects. Similarly, sheet members 41, 55 and 39 (FIG. 6) include slots to receive the end side walls of holder 112.

Figure 2:
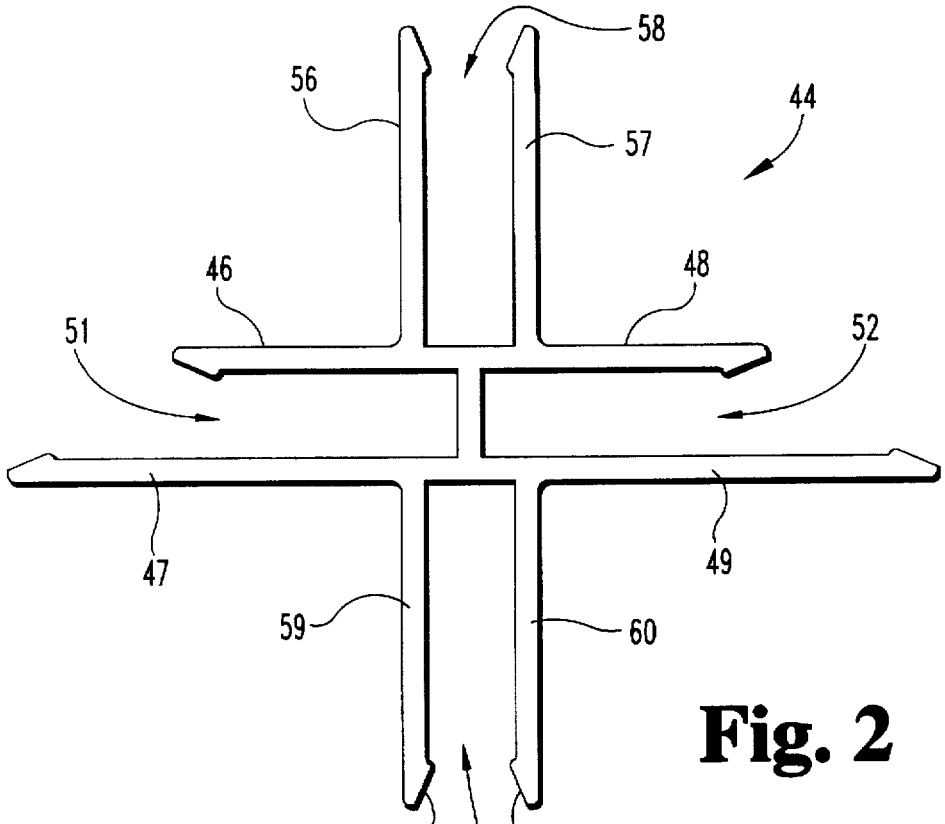
FIG. 2 is an end view of the cross-shaped holders.
Figure 11:
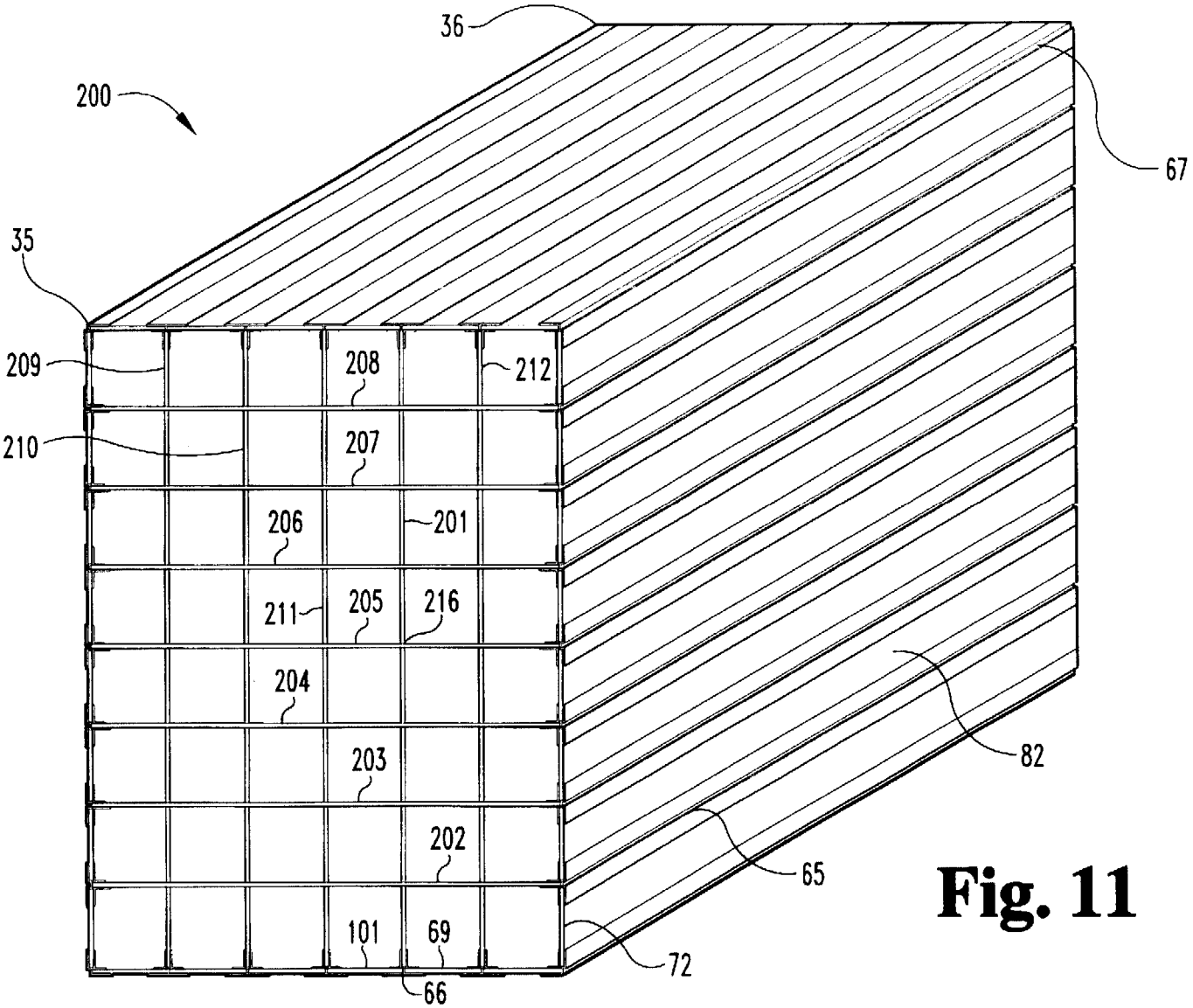
FIG. 11 is a perspective view of an alternate embodiment of the storage device.
Figure 12:
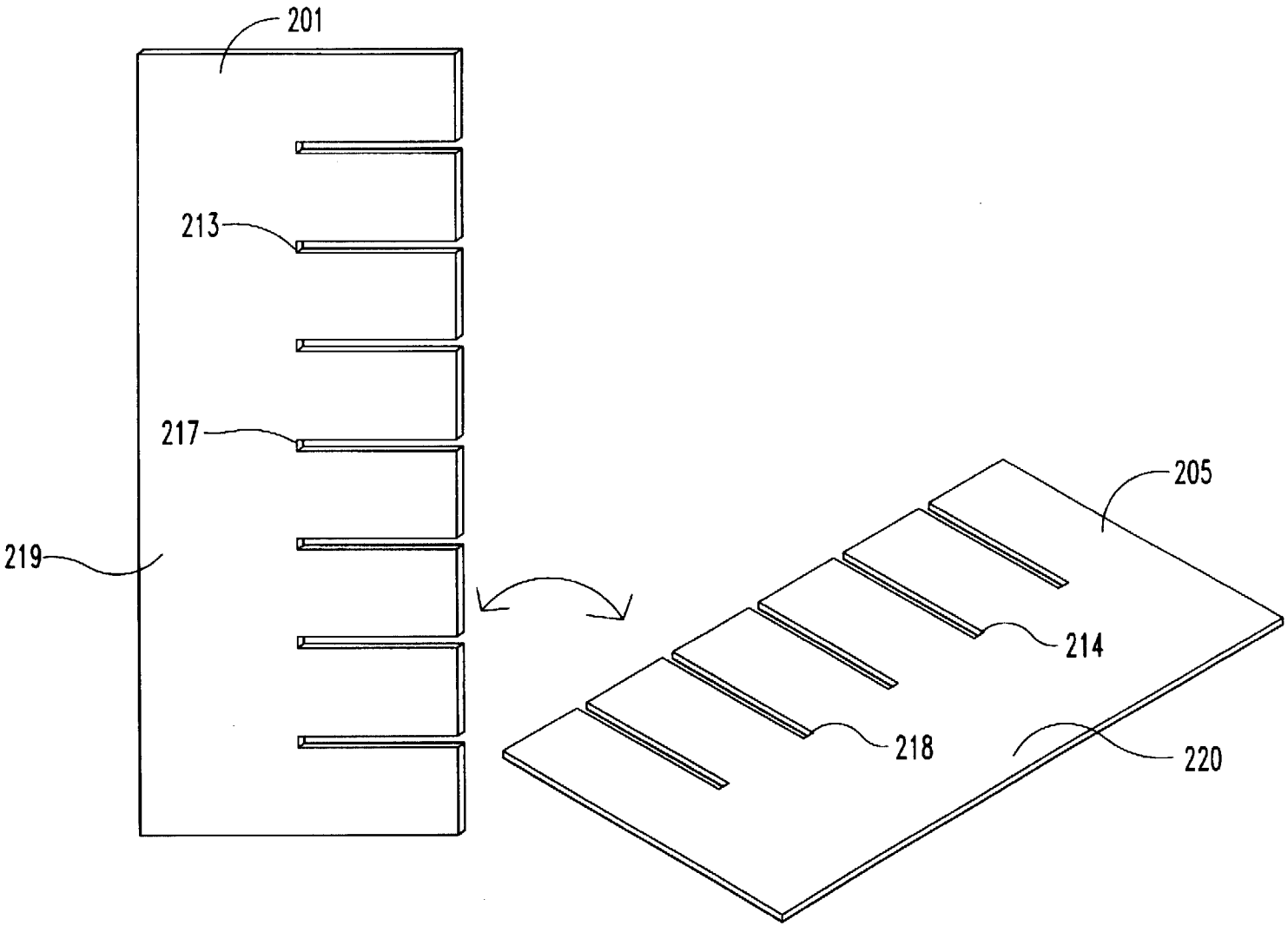
FIG. 12 is an exploded perspective view of vertical and horizontal sheet members being assembled together.

An alternate embodiment of the storage device 200 is depicted in FIG. 11 and is identical to storage device 20 with the exception that the individual horizontally extending sheet members arranged in a horizontal row are replaced by a single horizontally extending sheet member and with the exception that the vertically extending individual sheet members of FIG. 1 arranged in a vertical row are replaced by a single vertically extending sheet member. The cross-shaped holders of FIG. 2 are not utilized in the storage device 200 which does include the T-shaped side and end holders of FIGS. 3 and 4 and the L-shaped corner holders of FIG. 5. Caps are mounted to the T-shaped holders and corner holders in a manner as previously described. Storage device 200 as shown has six vertical rows and eight horizontal rows of compartments. Thus, seven horizontally extending sheet members 202–208 are interlocked with five vertically extending sheet members 201, 209–212. Two such interlocking sheet members are depicted in FIG. 12. Vertically extending sheet member 201 includes seven slots 213 to receive the seven horizontally extending sheet members 202–208. Likewise, horizontally extending sheet member 205 includes five slots 214 to receive the five vertically extending sheet members 201, 209–212. Thus, the intersection 216 (FIG. 11) of sheet members 201 and 205 is accomplished by extending sheet member 205 into slot 217 (FIG. 12) whereas sheet member 201 extends into slot 218 of member 205. Thus, the opposite side edges of member 205 forming slot 218 are positioned in the solid or unslotted portion 219 of sheet 201 whereas the opposite side edges of sheet member 201 forming slot 217 are positioned adjacent the solid or unslotted side portion 220 of sheet member 205. Such construction is conventional in the cardboard box industry for forming separators within a box. In similar fashion, the remaining vertically extending members and horizontally extending members are inter-connected.

The top ends of vertically extending members 201, 209–212 fit into the downwardly extending and upwardly extending flanges of holders 66 which, in turn, have a plurality of individual horizontally extending members positioned between the horizontally extending flanges of the holders in a manner identical to that described for storage device 20. That is, individual horizontally extending sheet members 69 and 101 (FIG. 11) extend into the horizontally formed recesses of holder 66 whereas the single vertically extending sheet 201 extends into the upwardly opening recess formed by holder 66. Likewise, a plurality of vertically extending individual sheet members extend into the vertically opening recesses formed by holders 65 (FIG. 11) in a manner identical to that described for storage device 10. For example, vertically extending sheet members 72 and 82 extend into the vertically opening recesses of holder 65 whereas the single horizontally extending sheet 202 extends into the horizontally opening recess of holder 65. All of the holders and individual sheet members including sheet members 202–208 and 201, 209–212 extend continuously from end 35 to end 36 of storage device 200.

Figure 9:
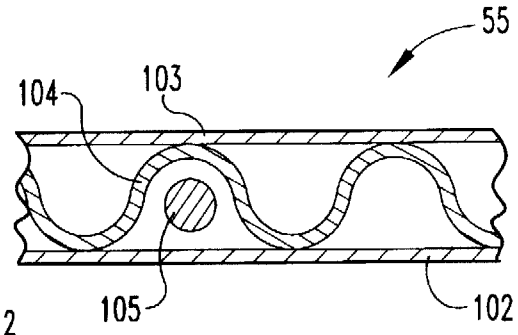
FIG. 9 is an enlarged fragmentary cross-sectional view taken along the line 9—9 of FIG. 8 and viewed in the direction of the arrows.

The internally located sheet shaped horizontally extending members 202–208 and the internally located sheet shape vertically extending members 201, 209–212 are constructed in the same manner as depicted for sheet 55 in FIG. 9 in that they include a pair of plastic sheets separated apart but connected together by plastic corrugated intermediate sheet. All of the horizontally extending internal sheets 202–208 are the same size. Likewise, the vertically extending internal sheets 201, 209–212 are the same size.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A storage device having a plurality of parallel extending compartments comprising:

a plurality of sheet shaped horizontally extending members having first edge portions, said horizontally extending members arranged in vertical rows and horizontal rows;

a plurality of sheet shaped vertically extending members having second edge portions, said vertically extending members spacing said horizontal rows apart cooperatively with said horizontally extending members defining a plurality of compartments;

a plurality of cross shaped holders each having a pair of spaced apart first flanges and a pair of spaced apart second flanges with said first flanges opening in an opposite direction than said second flanges receiving adjacent but spaced apart first edge portions of said horizontally extending members arranged in horizontal rows, said holders further having a pair of spaced apart third flanges and a pair of spaced apart fourth flanges with said third flanges opening in an opposite direction than said fourth flanges receiving adjacent but spaced apart second edge portions of said vertically extending members;

a plurality of T-shaped side holders each having a pair of spaced apart fifth flanges opening inwardly toward said compartments receiving said first edge portions of said horizontally extending members, said T-shaped holders further having a pair of spaced apart sixth flanges and a pair of spaced apart seventh flanges opening in opposite directions and receiving said second edge portions of said vertically extending members;

a plurality of T-shaped end holders each having a pair of spaced apart eighth flanges opening inwardly toward said compartments receiving said second edge portions of said vertically extending members, said T-shaped end holders further having a pair of spaced apart ninth flanges and a pair of spaced apart tenth flanges opening in opposite directions and receiving said first edge portions of said horizontally extending members; and, a plurality of L-shaped holders each having a pair of spaced apart eleventh flanges and a pair of spaced apart twelfth flanges arranged perpendicularly receiving respectively said first edge portions and said second edge portions forming corners of the storage device;

said horizontally extending members and said vertically extending members are supported along their entire lengths by said cross-shaped holders;

said horizontal extending members and said vertically extending members each include a pair of sheets separated by corrugated shaped elements.

2. The storage device of claim 1 and further comprising:

a plurality of wires sandwiched between said pair of sheets providing rigidity to said horizontal extending members and said vertically extending members.

3. A storage device having a plurality of parallel extending compartments comprising:

a plurality of sheet shaped horizontally extending members having first edge portions, said horizontally extending members arranged in vertical rows and horizontal rows;

a plurality of sheet shaped vertically extending members having second edge portions, said vertically extending members spacing said horizontal rows apart cooperatively with said horizontally extending members defining a plurality of compartments;

a plurality of cross shaped holders each having a pair of spaced apart first flanges and a pair of spaced apart second flanges with said first flanges opening in an opposite direction than said second flanges receiving adjacent but spaced apart first edge portions of said horizontally extending members arranged in horizontal rows, said holders further having a pair of spaced apart third flanges and a pair of spaced apart fourth flanges with said third flanges opening in an opposite direction than said fourth flanges receiving adjacent but spaced apart second edge portions of said vertically extending members;

a plurality of T-shaped side holders each having a pair of spaced apart fifth flanges opening inwardly toward said compartments receiving said first edge portions of said horizontally extending members, said T-shaped holders further having a pair of spaced apart sixth flanges and a pair of spaced apart seventh flanges opening in opposite directions and receiving said second edge portions of said vertically extending members;

a plurality of T-shaped end holders each having a pair of spaced apart eighth flanges opening inwardly toward said compartments receiving said second edge portions of said vertically extending members, said T-shaped end holders further having a pair of spaced apart ninth flanges and a pair of spaced apart tenth flanges opening in opposite directions and receiving said first edge portions of said horizontally extending members; and, a plurality of L-shaped holders each having a pair of spaced apart eleventh flanges and a pair of spaced apart twelfth flanges arranged perpendicularly receiving respectively said first edge portions and said second edge portions forming corners of the storage device;

said horizontally extending members and said vertically extending members are supported along their entire lengths by said cross-shaped holders;

each of said first flanges and each of said second flanges have an upper non-load bearing flange and a lower load bearing flange, each of said fifth flanges also have an upper non-load bearing flange and a lower load bearing flange.

4. A storage device comprising:

a plurality of sheet shaped horizontally extending internal members having first edge portions, said horizontally extending members arranged in rows;

a plurality of sheet shaped vertically extending internal members having second edge portions, said horizontally extending internal members and said vertically extending internal members including mating slots connecting the vertically extending internal members with the horizontally extending internal members together at right angles defining a plurality of compartments;

a plurality of sheet shaped horizontally extending external members having third edge portions;

a plurality of sheet shaped vertically extending external members having fourth edge portions;

a plurality of T-shaped side holders each having a pair of spaced apart first flanges opening inwardly toward said compartments receiving said first edge portions, said T-shaped holders further having a pair of spaced apart second flanges and a pair of spaced apart third flanges opening in a direction opposite said second flanges receiving said fourth edge portions;

a plurality of T-shaped end holders each having a pair of spaced apart fourth flanges opening inwardly toward said compartments receiving said second edge portions, said T-shaped end holders further having a pair of spaced apart fifth flanges and a pair of spaced apart sixth flanges opening in a direction opposite said fifth flanges receiving said third edge portions; and, a plurality of L-shaped corner holders each having a pair of spaced apart seventh flanges and a pair of spaced apart eighth flanges arranged perpendicularly together receiving said third edge portions and said fourth edge portions forming corners of the storage device;

the flanges of the holders have inwardly projecting barbs which frictionally but releasably engage and hold the edge portions securing the members together but allowing removal and reinsertion of different sized members for sizing of the compartments;

said horizontal extending internal members and said vertically extending internal members each include a pair of sheets separated by corrugated shaped elements and are plastic, said horizontally extending internal members are the same size and said vertically extending internal members are the same size.

* * * * *